US012240651B2

(12) United States Patent
Plattner et al.

(10) Patent No.: US 12,240,651 B2
(45) Date of Patent: Mar. 4, 2025

(54) PLASTIC CONTAINER

(71) Applicant: GEORG UTZ HOLDING AG, Bremgarten (CH)

(72) Inventors: Patrik Plattner, Sarmenstorf (CH); Axel Ritzberger, Altendorf (CH); Philip Schaniel, Bremgarten (CH)

(73) Assignee: GEORG UTZ HOLDING AG, Bremgarten (CH)

( * ) Notice: Subject to any disclaimer, the term of this patent is extended or adjusted under 35 U.S.C. 154(b) by 82 days.

(21) Appl. No.: 18/040,004

(22) PCT Filed: Jul. 7, 2021

(86) PCT No.: PCT/IB2021/056084

§ 371 (c)(1),
(2) Date: Jan. 31, 2023

(87) PCT Pub. No.: WO2022/034391

PCT Pub. Date: Feb. 17, 2022

(65) Prior Publication Data

US 2023/0312172 A1 Oct. 5, 2023

(30) Foreign Application Priority Data

Aug. 10, 2020 (CH) ..... 990/20

(51) Int. Cl.
*B65D 21/02* (2006.01)
*B65D 6/00* (2006.01)
*B65D 6/34* (2006.01)

(52) U.S. Cl.
CPC ..... *B65D 21/0212* (2013.01); *B65D 11/10* (2013.01); *B65D 11/22* (2013.01)

(58) Field of Classification Search
CPC ..... B65D 21/0212; B65D 11/10; B65D 11/22
(Continued)

(56) References Cited

U.S. PATENT DOCUMENTS 4,673,087 A * 6/1987 Webb ..... B65D 11/1873 206/508
6,886,787 B2 * 5/2005 Stahl ..... B62B 3/1476 206/508

(Continued)

FOREIGN PATENT DOCUMENTS

CH 683087 A5 1/1994
DE 200 20 879 U1 5/2001

(Continued)

OTHER PUBLICATIONS

International Search Report mailed on Oct. 1, 2021, in connection with corresponding International Application No. PCT/IB2021/056084 (5 pp., including machine-generated English translation).

*Primary Examiner* — J. Gregory Pickett
*Assistant Examiner* — Niki M Eloshway
(74) *Attorney, Agent, or Firm* — McCormick, Paulding & Huber, PLLC

(57) ABSTRACT

A plastic container (1) has a first base and four side walls (13, 14) projecting perpendicularly upwards with a circumferential edge (15) on the upper edge of said walls and a circumferential rib (16) of the lower end of said walls. According to the invention, the container (1) includes a second base (17), which is arranged on the underside of the first base and encloses same. A flat base surface (18, 20) of the second base (17) extends parallel to the first base and beyond the extent of the first base to the extent of the outer ends of the circumferential rib (16) on the side walls (13, 14). A frame (19) on the second base (17) having a circumferential wall (22) extends to the circumferential rib (16) and encloses the lateral edges of the first base. The plastic container (1) can be placed in high-bay warehouses having narrow, rail-like shelves and can be centered and reliably
(Continued)

stacked by means of elongate centering elements on the edge (15) and recesses (26) in the second base (17).

15 Claims, 11 Drawing Sheets

(58) Field of Classification Search
USPC ..... 220/657; 206/508
See application file for complete search history.

(56) References Cited

U.S. PATENT DOCUMENTS

| | | | | |
|---|---|---|---|---|
| 2003/0123878 | A1* | 7/2003 | Li | G02B 6/29386 398/79 |
| 2020/0055534 | A1* | 2/2020 | Hassell | B62B 3/16 |

FOREIGN PATENT DOCUMENTS

| | | | | |
|---|---|---|---|---|
| EP | 3098136 | A1 * | 11/2016 | B62B 3/10 |
| FR | 1 271 931 | A | 9/1961 | |
| WO | WO-2007028194 | A1 * | 3/2007 | B62B 5/0093 |
| WO | WO-2014091842 | A1 * | 6/2014 | B65D 11/10 |

* cited by examiner

PLASTIC CONTAINER

CROSS-REFERENCE TO RELATED APPLICATION

This application is a National Stage application of International Patent Application No. PCT/IB2021/056084, filed Jul. 7, 2021, which claims the priority of Swiss patent application 0990/20, filed Aug. 10, 2020, the disclosure of each of which is incorporated herein by reference in its entirety.

TECHNICAL FIELD

The invention relates to a stackable container made of plastics for the storage and transportation of goods. In particular, it relates to the design of the base and the circumferential upper edges of the side walls of such a container.

BACKGROUND OF THE INVENTION

Stackable plastic containers available on the market today have, for example, a circumferential edge on the upper edge of their side walls and a circumferential rib at the lower end of the side walls above the level of the base, the rim and the rib projecting outwardly perpendicular to the side walls. A first container of this type can be stacked on a second container by placing the circumferential rib at the lower end of the side walls of the first container on top of the circumferential edge at the upper end of the side walls of the second container. In doing so, the base of the first, upper container fits snugly within the side walls of the second, lower container, preventing the stacked containers from shifting relative to each other. Such containers are shown, for example, in FIGS. 1*a-d* and FIG. 15. A first container 1 in FIG. 1*a* has a base 2 and side walls 3, 4 with an upper circumferential edge 5 at the upper end of the side walls and a circumferential rib 6 at the lower end of the side walls. A plurality of reinforcing ribs 7 are located on the outer sides of the side walls 3 and 4 and at the corners of the container 1. The base 2 extends below the level of the circumferential rib 6 and only as far out as the outer sides of the side walls 3 and 4, as indicated by lines A. FIGS. 1*b-d* show two such containers 1 and 8 in a stack. The circumferential rib 6 of the lower container 1 rests on the upper edge 5 of the lower container 8, and the base of the upper container 1 is inserted inside the side walls of the container 8. FIG. 15 shows prior art containers placed in a high rack having vertical elements 31 and L-shaped elements providing narrow horizontally extending rail-shaped support surfaces 32 for the containers 1. In this case, the bases 2 of the containers 1, the extent of which is indicated by the lines A, rest on a limited surface on the horizontal elements 32.

SUMMARY

The present invention has the object of further developing such plastic containers so that they can also be reliably used in modern high-bay warehouses having rail-shaped support surfaces in the shelves.

According to the invention, the plastic container has a first base with an underside facing outwards and an upper side facing inwards of the container and four side walls projecting vertically from the first base. A circumferential edge extends on the side walls the upper along edge thereof and a circumferential rib extends along the lower end thereof, the rib extending outwardly from the outer sides of the side walls perpendicular to the side walls. According to the invention, the container has a second base which is arranged on the underside of the first base and encloses the latter on its underside and on its lateral edges. The second base has an overall flat base surface which extends parallel to the first base beyond the extent of the first base to the extent of the outer ends of the circumferential rib on the side walls.

In a first embodiment, the second base has a flat middle part and a frame surrounding the middle part. In this case, the middle part extends over the entire surface of the underside of the first base. On the one hand, the frame extends outwardly starting from the circumference of the middle part in the plane of the middle part and, on the other hand, has a circumferential wall which extends perpendicular to the plane of the middle part of the second base in the direction of the circumferential rib on the side walls of the container. The circumferential wall of the second base thus extends parallel to the side walls of the container.

The invention provides the advantage that the support surface of the container according to the invention is enlarged and lies in a single plane, in contrast to the aforementioned containers of the prior art. That is, the base does not include a step. This allows, in particular, improved and reliable horizontal storage in a high rack having narrow L-shaped shelves. Such L-shaped shelves, as mentioned above, are in the form of two parallel rails attached to vertical elements of the high rack on which the containers can stand. Since the containers according to the invention have a homogeneous support surface in one plane, they can be placed on the rail-like shelves, their support surface being enlarged due to the second base. Tilting and skewing due to steps on the undersides of containers are avoided.

In a preferred embodiment of the invention, the frame of the second base has reinforcing ribs which are arranged on the inside of the circumferential wall of the frame and are perpendicular to the plane of the middle part of the second base.

In one embodiment of the invention, the reinforcing ribs each extend at an angle unequal to 90° with respect to the circumferential wall of the frame.

In another embodiment of the invention, the second base has reinforcing ribs arranged in a grid pattern in its middle part and attached to the underside of the first base. The reinforcing ribs extend from the upper side of the second base to the underside of the first base. Here, their upper ends are connected to the underside of the first base.

In another embodiment, the second base has a continuous solid surface on its underside which extends only over the planar middle part. In the region of the frame, however, the second base has no solid surface on its underside.

The second base is preferably attached to the first base by means of welding, with the upper ends of the reinforcing ribs of the central part of the second base being welded to the underside of the first base.

In a preferred embodiment of the invention, the container has a plurality of recesses on the underside of the second base in the region of its frame and a plurality of upwardly projecting elements on the upper, circumferential edge on the side walls, wherein the positions of the projecting elements correspond to the positions of the recesses in such a manner that when two containers are stacked one on top of the other, the projecting elements can be inserted into the recesses. In this case, the circumferential wall of the frame of the container standing on top comes to rest on the circumferential edge at the upper edge of the side walls of the container standing on the bottom.

The recesses in the second base and the associated projecting elements on the circumferential upper edge allow such containers to be stacked in a centered manner.

In a preferred embodiment, the projecting elements are elongated and the recesses in the second base are correspondingly also elongated with the same dimensions. The elongated shape of the projecting elements and recesses allows centering of a stack of multiple containers.

The plastic container according to the invention can also be manufactured in a retrofit of an existing container according to the mentioned prior art. For this purpose, the second base is manufactured by means of an injection molding process and then bonded to the underside of an existing container by welding.

Further advantages of the invention are apparent from the dependent patent claims and from the following description in which the invention is explained in more detail by means of an exemplary embodiment shown in the schematic drawings.

BRIEF DESCRIPTION OF THE DRAWINGS

FIGS. 6-9 show the container from FIG. 5, wherein the first and second bases are separated from each other in each case and their position relative to each other are shown, of which FIG. 6 shows the container in side view, FIG. 7 shows the container in a cross-section according to VII-VII in FIG. 5, FIG. 8 shows the container in perspective view, FIG. 9 shows a side view of the container from FIG. 6 according to IX.

In the figures, the same reference signs have been used for the same elements in each case, and first-time explanations apply to all figures unless expressly stated otherwise.

DESCRIPTION OF THE PREFERRED EMBODIMENTS

Figure 1A:
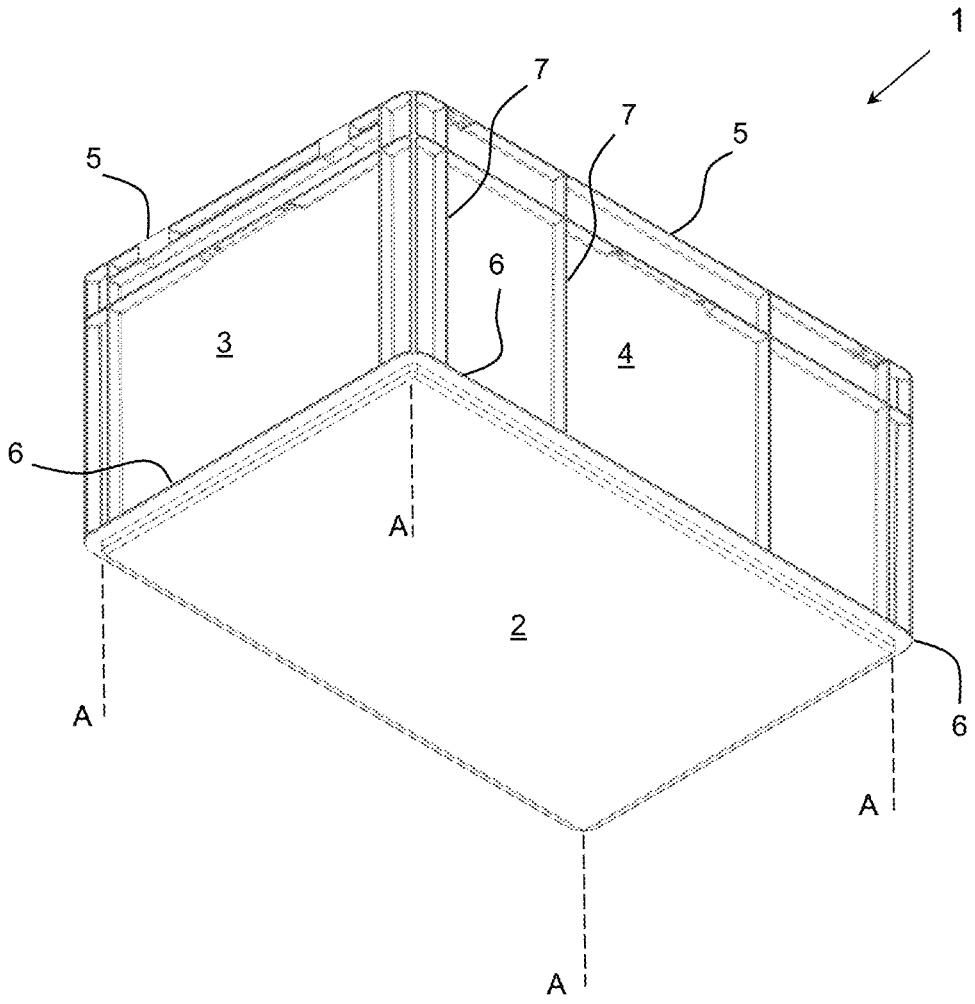
Fig. 1a Prior Art
FIG. 1*a* shows a prior art container in a perspective view from below.
Figure 1B:
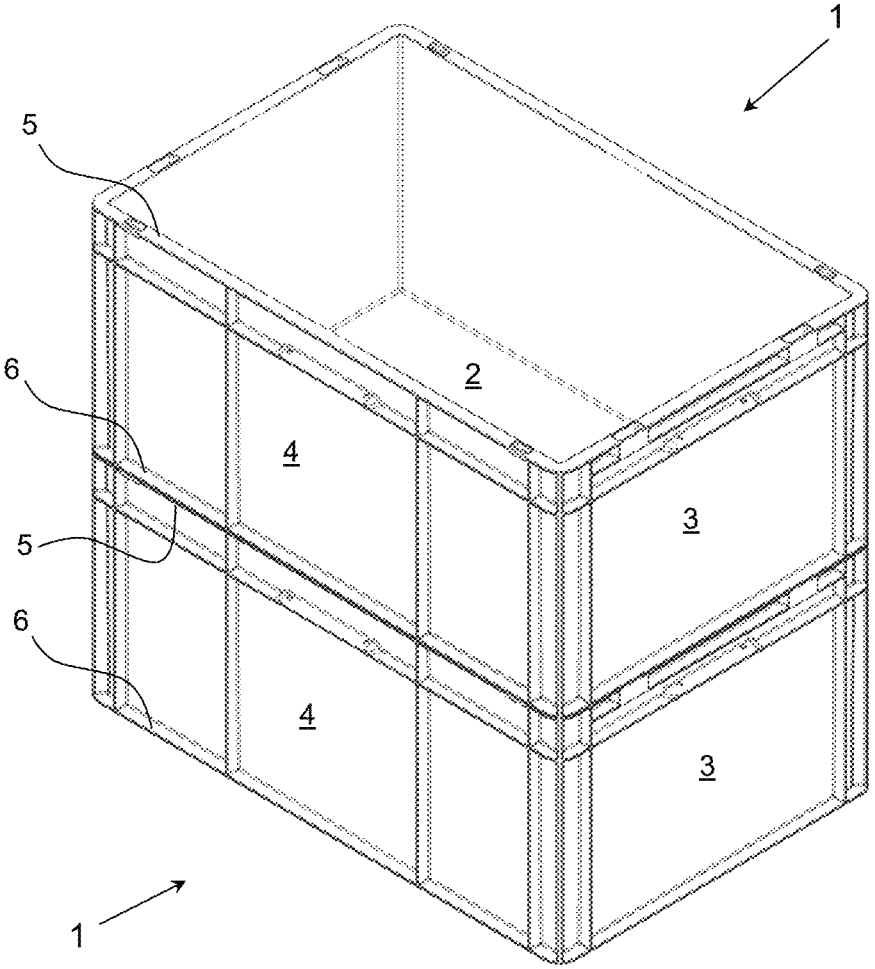
Fig. 1b Prior Art
FIG. 1*b* shows two containers from FIG. 1*a* stacked on top of each other.
Figure 1C:
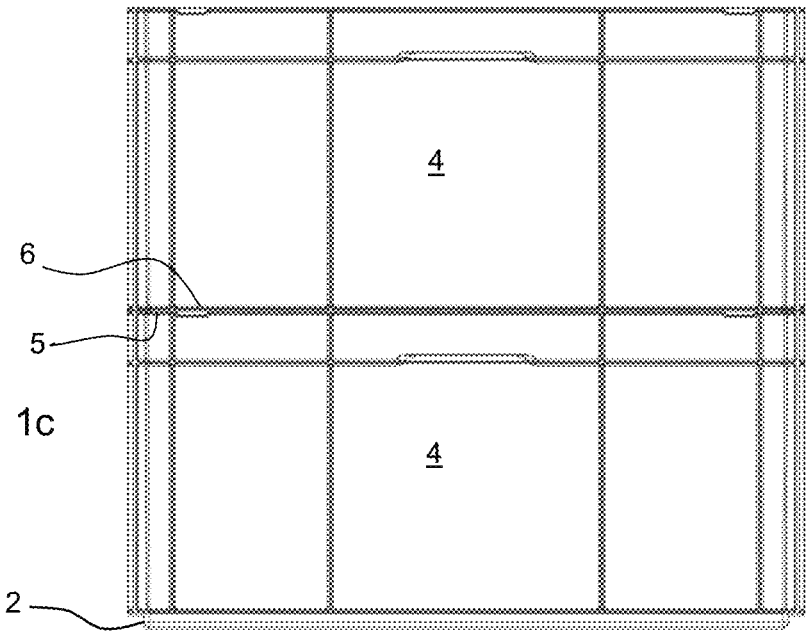
FIG. 1*c* shows the stack from FIG. 1*b* in a side view.
Figure 1D:
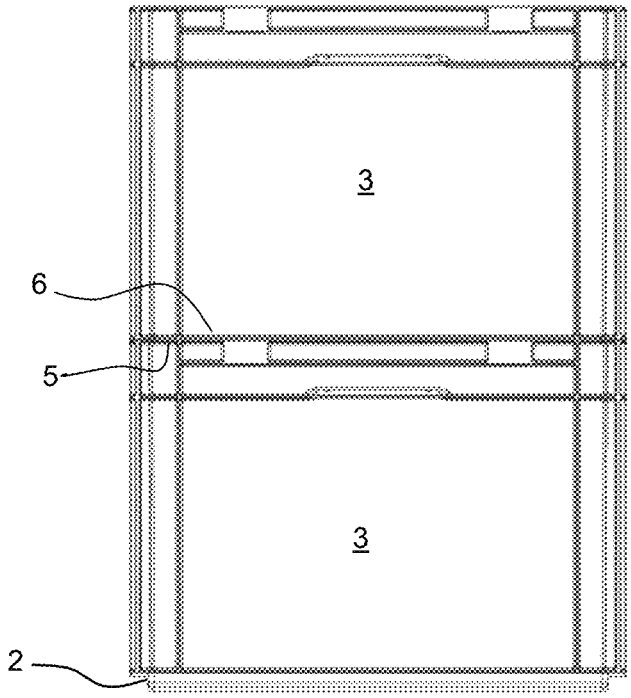
Fig. 1d Prior Art
FIG. 1*d* shows the stack from FIG. 1*c* in a side view rotated by 90°.

FIGS. 2 to 5 collectively show various views of a container 11 according to the invention having a first base 12 with an underside and an upper side inside the container, of which the upper side thereof is visible here inside the container. Short side walls 13 and long side walls 14 project vertically from the upper side of the base 12. The short and long side walls 13 and 14 are surrounded at their upper end by an upper circumferential edge 15, with a circumferential rib 16 being arranged at the level of the lower end of all side walls 13 and 14. Both the circumferential edge 15 at the upper edge and the rib 16 at the lower end project outwardly and perpendicular to the side walls. According to the invention, a second base 17 is arranged on the lower side of the first base 12, which second base has a substantially planar, flat middle part 18 and a frame 19 surrounding the middle part, which enclose the first base 12 at its underside and its lateral edges. The planar middle part 18 extends parallel to the first base 12 to the extent of the outer sides of the first base 12 and the downward extension of the side walls 13 and 14. The frame 19 of the second base 17 surrounds the middle part 18 at its circumference. On the one hand, the frame has a planar, flat part 20 which extends outwardly from the circumference of the planar middle part 18 in the plane of the middle part 18. On the other hand, at the outer circumference of its flat part 20, it comprises a circumferential wall 22 perpendicular to the flat part 20 and projecting in the direction of the circumferential rib 16 and surrounding the lateral edges of the first base 12.

Figure 4:
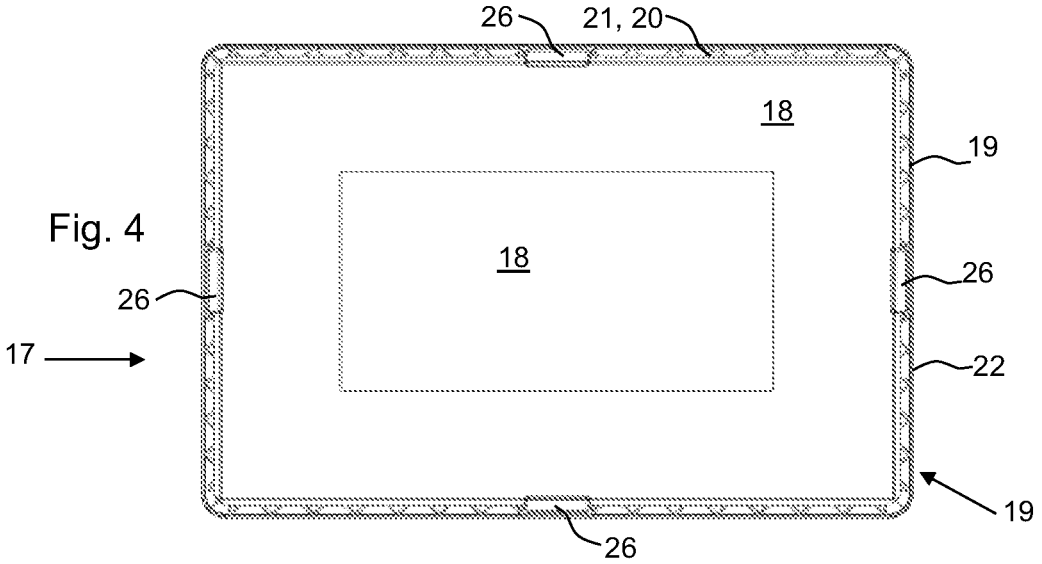
FIG. 4 shows the container according to the invention in a view from below.
Figure 5:
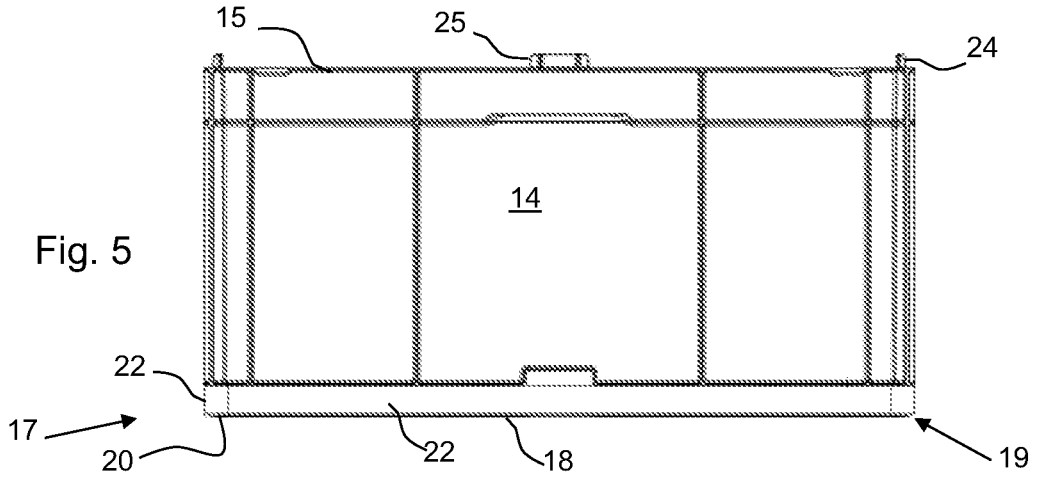
FIG. 5 shows the container according to the invention from FIG. 2 in a side view.
Figure 6:
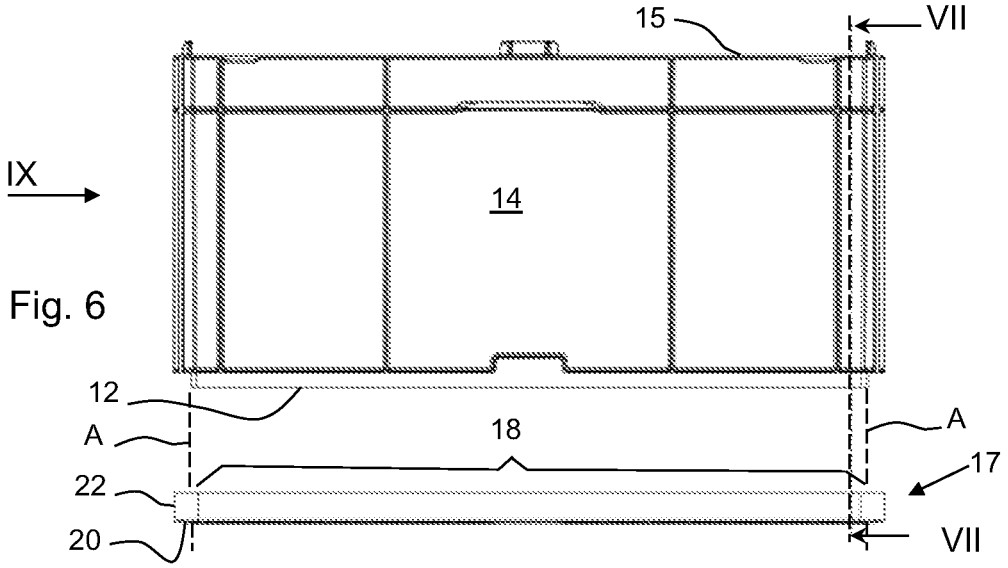
Figure 7:
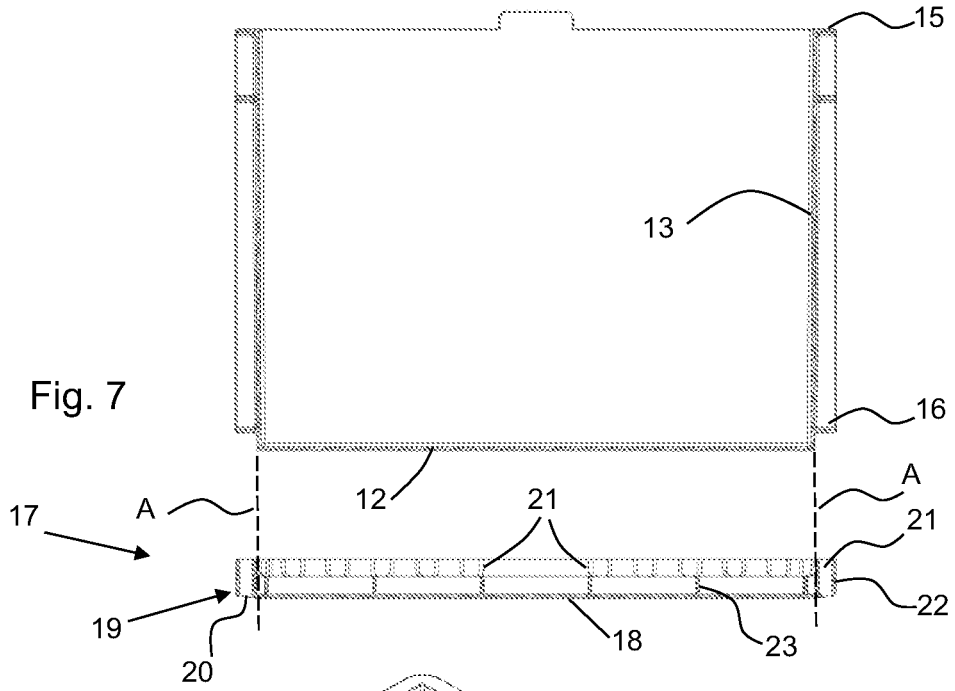
Figure 8:
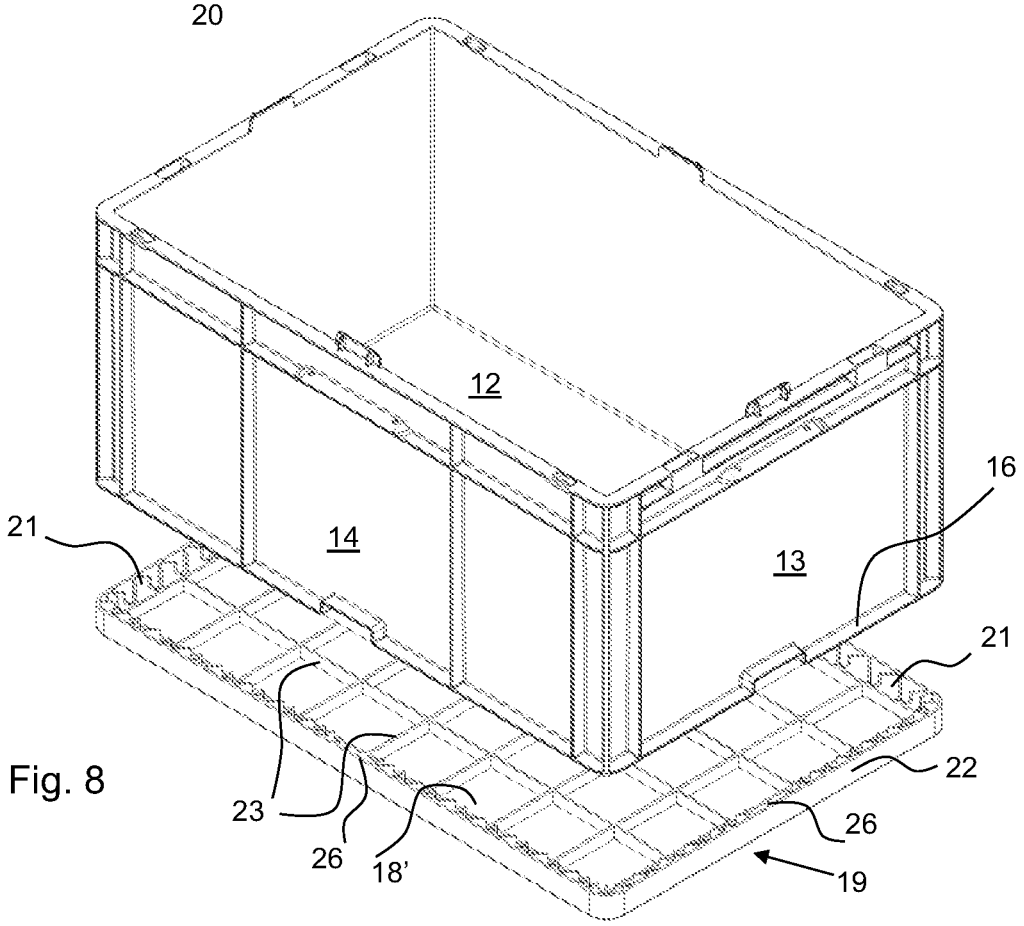

In the example shown, according to FIG. 4, the flat part 20 of the frame 19 is formed by multiple ribs 21 which are perpendicular to the plane of the flat middle part of the second base 17 and extend from the circumference of the flat middle part 18 to the circumferential wall 22 of the second base 17. The lower ends of the ribs 21 extend parallel to the plane of the first base 12 and in the plane of the lower side of the second base 17. As shown in FIGS. 7 and 8, the ribs 21 are slightly curved so that they extend around and surround the outer edge, i.e. the lateral edges, of the first base 12.

The lower side of the second base 17 has a solid continuous surface 18' in the middle part 18, while in the flat part 20 of the frame 19 there is no such continuous surface and the flat part 20 is partly open at the lower side and is formed only by the ribs 21. Thus, the frame 19 is not closed at its lower side.

Alternatively, the underside of the flat part 20 can also be solid.

FIGS. 6-9 show the container 11 according to the invention of which the second base 17 is shown separately in each case, wherein the position of the latter is shown in relation to the first base 12. In FIG. 7, the positions of the outer sides of the side walls 13 and the outer sides of the first base 12 are indicated by lines A. The planar, flat middle part 18 of the second base 17, which is attached to the underside of the first base 12, extends beyond the extent of the first base 12 up to the lines A. From the outer sides of the middle part 18, the flat part 20 of the frame 19 extends outwards in the plane of the middle part 18 up to the level of the outer ends of the circumferential rib 16. The circumferential wall 22 of the frame 19 is perpendicular to the flat part 20 and extends in the direction of the circumferential rib 16.

Figure 9:
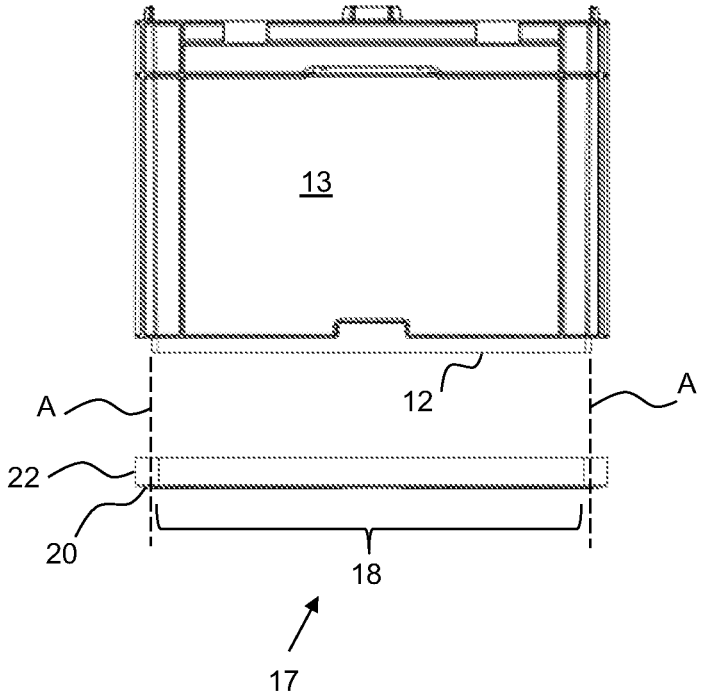

FIGS. 8 and 9 show the second base 17 and in particular reinforcing ribs 21 arranged in the frame 19. They extend perpendicular to the plane of the second base 17 and first base 12 and, for example, are at an angle unequal to 90° with respect to the circumferential wall 22.

Moreover, in this example, the middle part 18 of the second base 17 is provided with reinforcing ribs 23 which span the surface in a grid-like manner. For example, the reinforcing ribs 23 are arranged at right angles to the sides of the second base 17.

The second base 17 in this example has a continuous surface 18' on its underside, which extends only over the middle part 18. As a result, the frame 19 is open at the bottom in the region of the flat part 20 and the reinforcing ribs 21 of the frame 19.

The second base 17 is attached to the base 12 by welding, for example. In this case, the upper sides of the reinforcing ribs 23 are welded to the underside of the first base 12.

Figure 2:
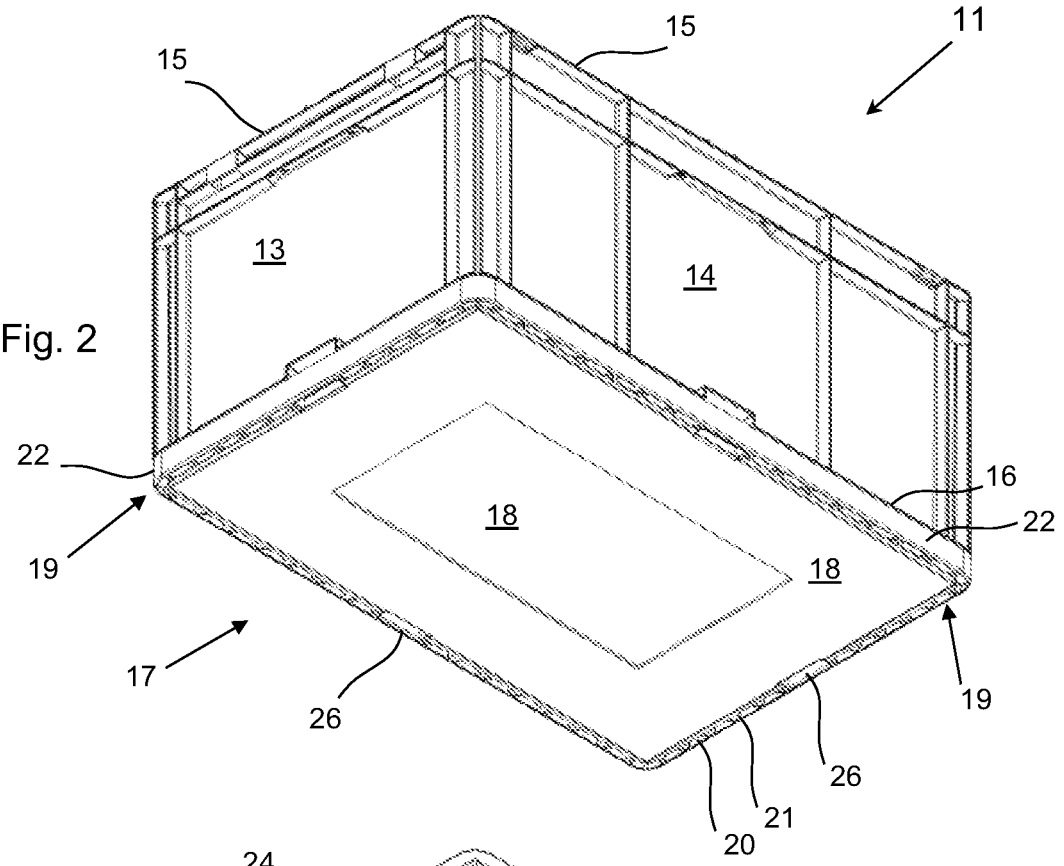
FIG. 2 shows an example of a container according to the invention in a perspective view from below.
Figure 3:
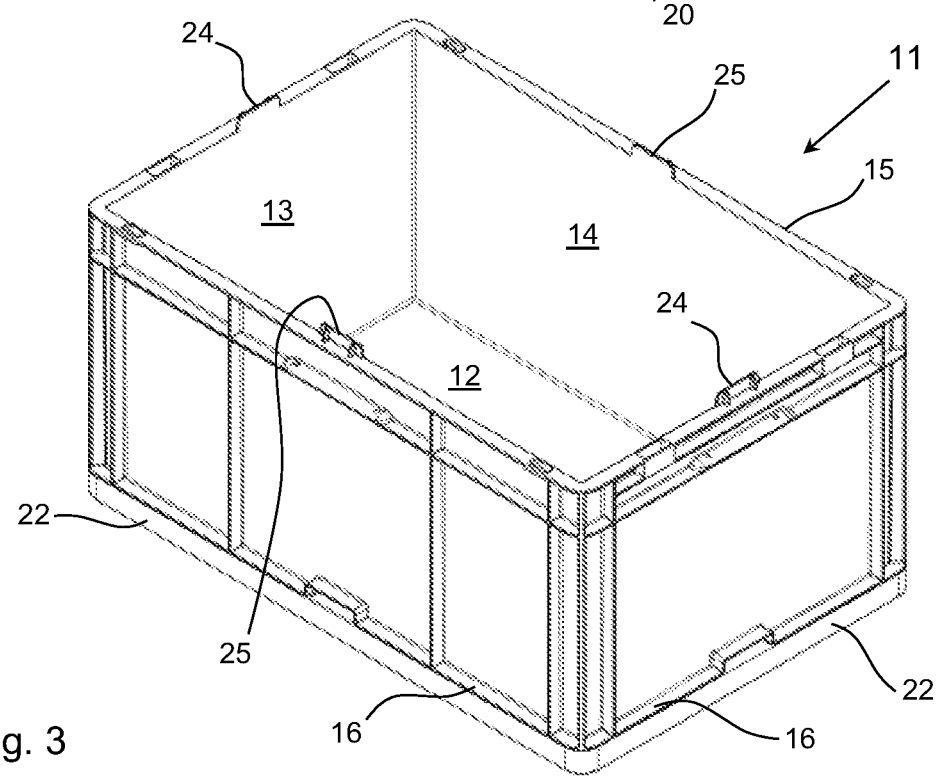
FIG. 3 shows the container from FIG. 2 in a perspective view from above.
Figure 10:
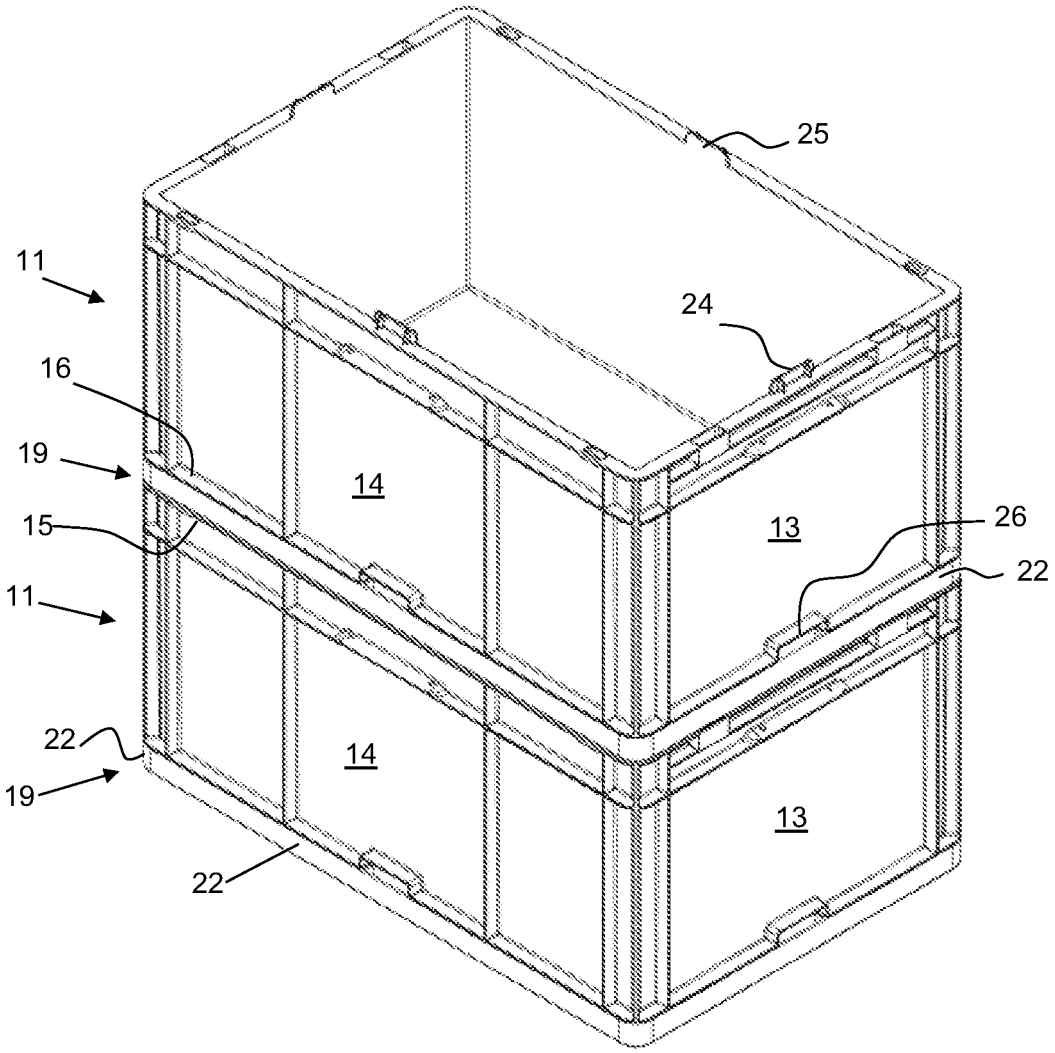
FIG. 10 shows a stack of containers according to the invention.
Figure 11:
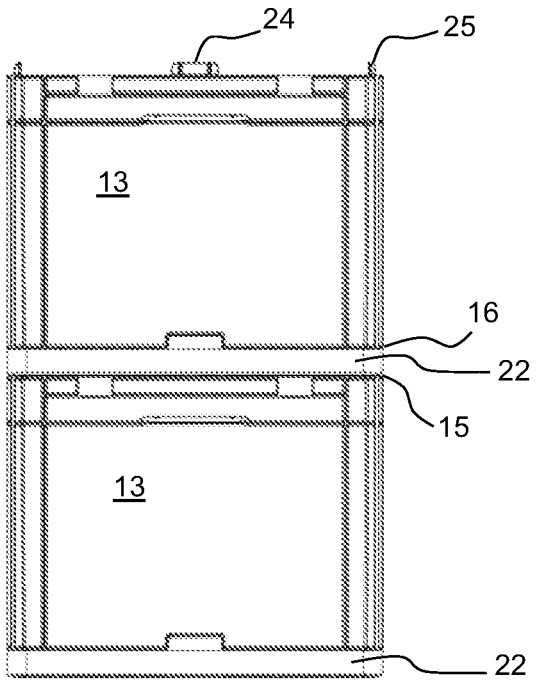
FIGS. 11 and 12 show views of the stack from FIG. 10 of the short and long sides of the container, respectively.
Figure 12:
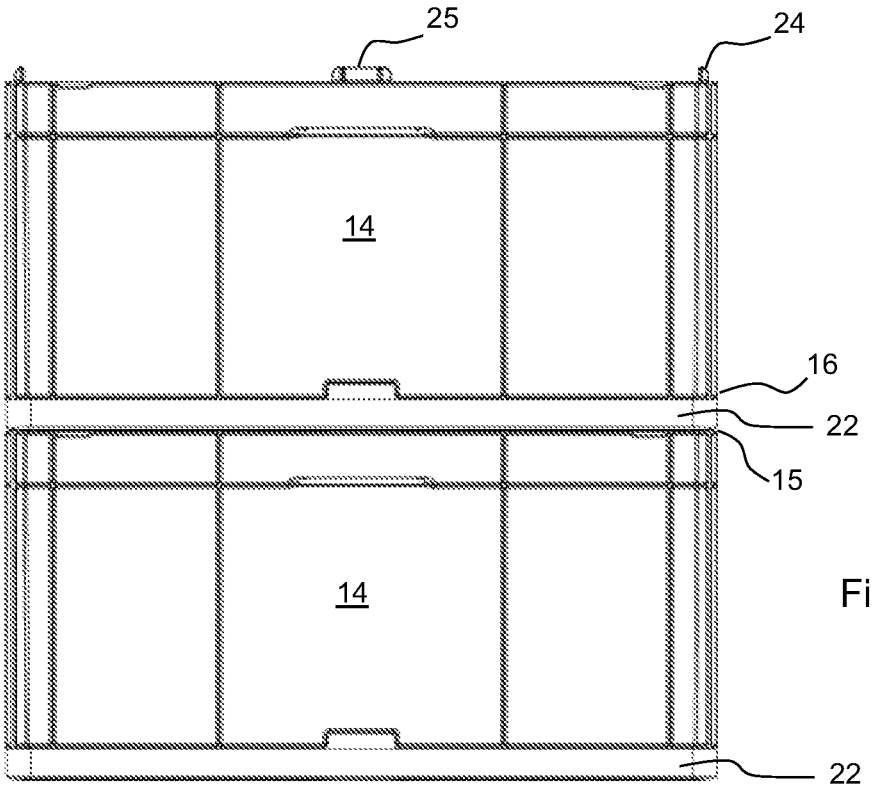

FIGS. 10-12 show a stack of two containers according to the invention in different views, in particular how the containers including the second base 17 can be stacked on top of each other. Centering elements 24 and 25 on the upper edges 15 of the side walls 13 and 14, respectively, and correspondingly formed recesses 26 on the underside of the second base 17, as shown in FIGS. 2, 4 and 8, serve this purpose.

Figure 13:
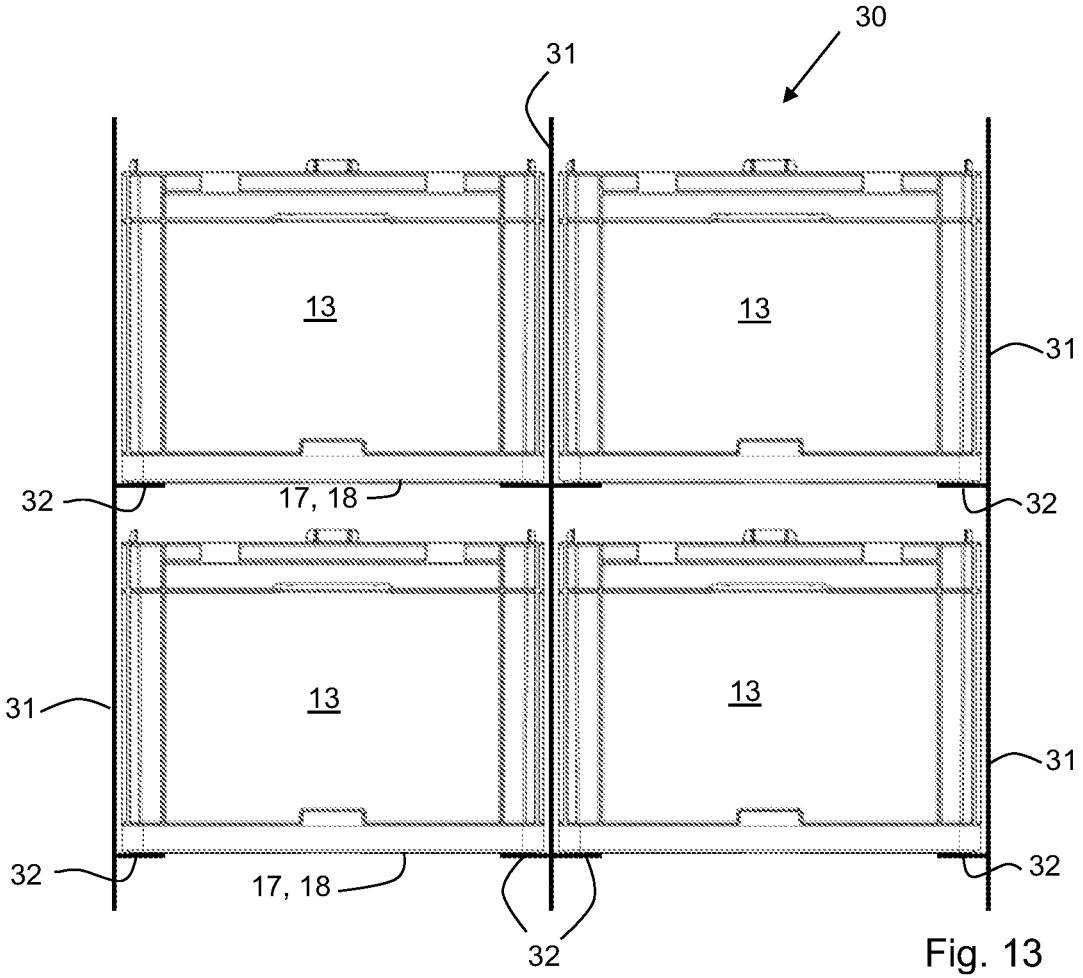
FIG. 13 shows multiple containers according to the invention placed in a high rack according to XIII-XIII from FIG. 14.
Figure 14:
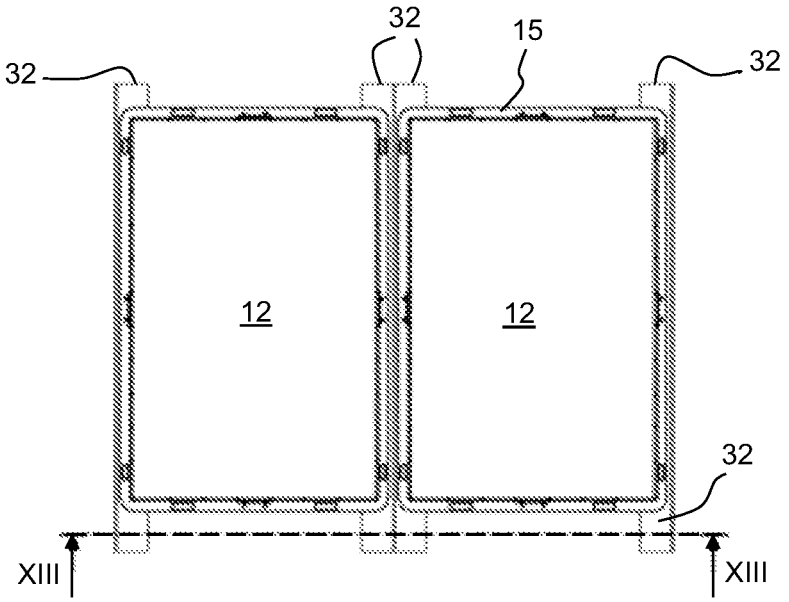
FIG. 14 shows the containers from FIG. 13 in a plan view.
Figure 15:
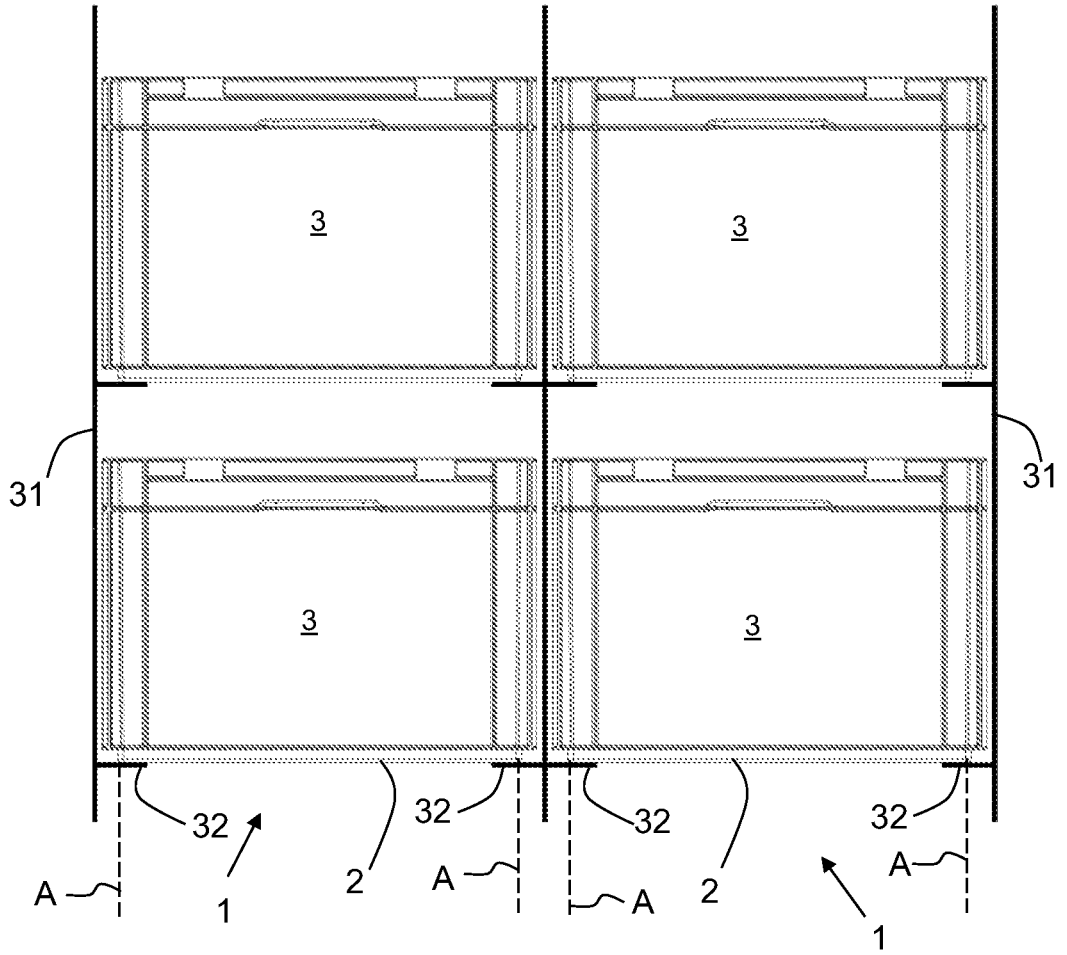
FIG. 15 shows containers according to the prior art placed in a high rack.

FIGS. 13 and 14 show the advantageous placement of containers 11 according to the invention in a high rack 30 with vertical elements 31 and narrow rail-like support surfaces 32 on which the containers 11 stand with the second base 17. As a result of the enlarged support surface of the containers 11 due to the extent of the second base 17 to the outer end of the circumferential rib 16 on the side walls as well as the upper circumferential edges 15, the containers 11 always stand horizontally and with enlarged support surface on the narrow shelf surfaces 32.

Although various embodiments of the present invention have been described and shown, the invention is not restricted thereto, but may also be embodied in other ways within the scope of the subject-matter defined in the following claims.

What is claimed is:

1. A plastic container having a first base with an underside and an upper side and four side walls projecting perpendicularly from the first base, wherein a circumferential edge extends along the upper edge of the side walls and a circumferential rib extends along the lower end of the side walls, wherein the plastic container has a second base which is arranged on the underside of the first base and encloses the same, wherein the second base has a planar base surface which extends parallel to the first base beyond the extent of the first base to the extent of the outer ends of the circumferential rib on the side walls, wherein the second base has a flat middle part and a frame surrounding the middle part, wherein the middle part extends over the entire surface of the underside of the first base, and the frame extends outwardly from the circumference of the middle part in the plane of the middle part and has at its outer edge a circumferential wall which extends perpendicular to the plane of the middle part of the second base in the direction of the circumferential rib on the side walls.

2. The plastic container according to claim 1, wherein the frame of the second base has reinforcing ribs which are arranged on the inner side of the circumferential wall of the frame and are perpendicular to the plane of the second base.

3. The plastic container according to claim 2, wherein each of the reinforcing ribs extend at an angle to the circumferential wall of the frame.

4. The plastic container according to claim 3, wherein the second base has reinforcing ribs arranged in a grid-like manner, which are attached to the underside of the first base.

5. The plastic container according to claim 3, wherein the second base has a continuous surface on its underside.

6. The plastic container according to claim 3, wherein the second base is attached to the first base by means of welding.

7. The plastic container according to claim 2, wherein the second base has a continuous surface on its underside.

8. The plastic container according to claim 2, wherein the second base is attached to the first base by means of welding.

9. The plastic container according to claim 1, wherein the second base has reinforcing ribs arranged in a grid-like manner, which are attached to the underside of the first base.

10. The plastic container according to claim 5, wherein the second base has a continuous surface on its underside.

11. The plastic container according to claim 1, wherein the second base has a continuous surface on its underside.

12. The plastic container according to claim 11, wherein the continuous surface of the second base extends only over the flat middle part thereof.

13. The plastic container according to claim 1, wherein the second base is attached to the first base by means of welding.

14. The plastic container according to claim 1, wherein the plastic container has a plurality of recesses on the underside of the second base as well as upwardly projecting elements at the circumferential edge on the upper edges of the side walls, wherein, when two identical plastic containers are stacked on top of each other, the projecting elements can be inserted into the recesses.

15. The plastic container according to claim 14, wherein the projecting elements and the recesses in the second base are elongated in shape.

* * * * *